US005350058A

United States Patent [19]

Keough

[11] Patent Number: 5,350,058

[45] Date of Patent: Sep. 27, 1994

[54] CHAMBERED ENCLOSURE FOR MAINTAINING A TOY IN A DRY CONDITION

[76] Inventor: Katherine A. Keough, 15172 Afton Hills Dr., Afton, Minn. 55001

[21] Appl. No.: 165,729

[22] Filed: Dec. 10, 1993

[51] Int. Cl.[5] ..... B65D 25/00; A63H 33/04; A63H 23/00

[52] U.S. Cl. ..... 206/45.34; 206/525; 446/75; 446/177; 446/153

[58] Field of Search ..... 446/75, 177, 153, 396, 446/325; 206/45.34, 525

[56] References Cited

U.S. PATENT DOCUMENTS 4,689,032 8/1987 Trossman ..... 446/153 X
4,781,643 11/1988 Holloway et al. ..... 446/75
5,261,848 11/1993 Kaplan et al. ..... 446/75 X

FOREIGN PATENT DOCUMENTS 585651 10/1959 Canada ..... 206/45.34
1553161 3/1990 U.S.S.R. ..... 446/325
2244658 12/1991 United Kingdom ..... 446/153

*Primary Examiner*—William I. Price
*Attorney, Agent, or Firm*—Patterson & Keough

[57] ABSTRACT

A chambered enclosure maintains a toy placed in the enclosure in a dry condition. The enclosure comprises sidewalls, a base, an openable portion, and a wall within the enclosure forming a dry chamber for receiving the toy and a wet chamber beneath the dry chamber. The wet chamber is designed to allow water to enter the wet chamber and further stabilize the enclosure when in a bathtub or other wet environment.

11 Claims, 2 Drawing Sheets

CHAMBERED ENCLOSURE FOR MAINTAINING A TOY IN A DRY CONDITION

FIELD OF THE INVENTION

The invention relates to a waterproof enclosure for maintaining a toy placed within the enclosure in a dry condition.

BACKGROUND OF THE INVENTION

Many children own toys which are designed for use only when the toys are in a dry condition. For example, children particularly enjoy stuffed animals and doll like objects which are normally only designed for use by children when the animals or objects are maintained in a dry condition. However, children often wish to take such toys into bath tubs and out in the rain. When the children do this the toys become wet and unusable for a considerable period of time. Some toys are even ruined by exposure to wet conditions. This invention maintains the toys in a dry condition while permitting the children to use the toy in a wet environment.

SUMMARY OF THE INVENTION

The invention comprises a chambered enclosure to maintain a toy in a dry condition during use by a child in a bathtub, shower, or in the rain. A dry chamber is designed for receipt of the toy, and a wet chamber is designed to stabilize the enclosure. The dry chamber is separated from the wet chamber by a wall which is preferably horizontally configured within the upright enclosure to enable the toy to rest on the wall during use. A plug or cover member prevents water from entering the dry chamber through a toy placement access. The wet chamber comprises ballasting means for allowing water to enter the wet chamber to further stabilize the toy, or for other effect.

DETAILED DESCRIPTION OF THE DRAWINGS

Figure 1:
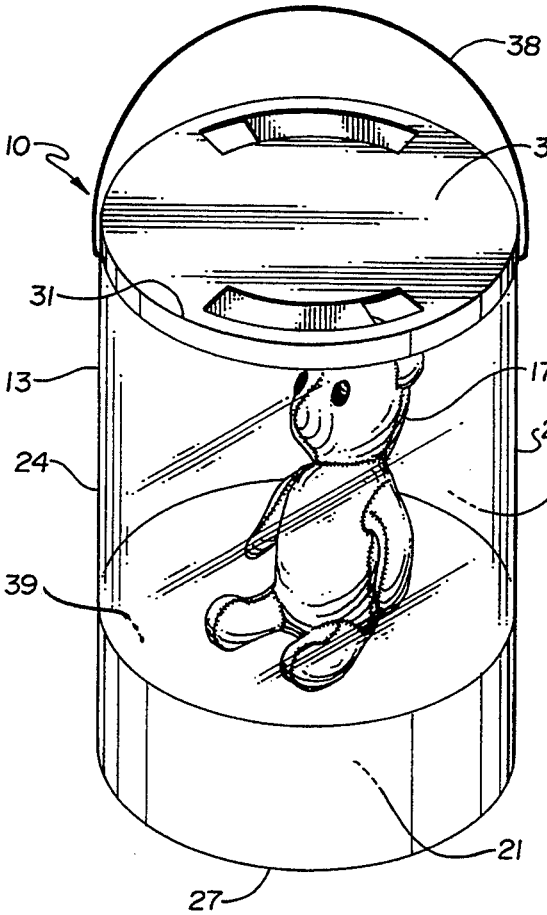
FIG. 1 is a perspective view of a chambered enclosure for holding a toy in a dry condition.

Children often desire to use toys such as stuffed animals or dolls in the bath tub or in the outdoors when it is raining. Such use often results in damage or ruin to the toy, but frequently results in minor conflict and sadness when supervisors or parents advise the child not to take the toy into a wet environment. Chambered enclosure 10 is provided to overcome this impediment to use of toys in a wet environment, and to reassure the children by the presence of a preferred toy. Chambered enclosure 10 provides means for holding a toy within the enclosure to maintain the toy in a dry condition while other portions, such as an outside portion 13, of the enclosure is getting wet. Chambered enclosure 10 may be variously shaped, however, the enclosure preferably comprises a plurality of chambers. In a preferred embodiment, chambered enclosure 10 comprises an elongate structure having a dry chamber 15 for receiving a toy 17, and a wet chamber 21 for providing ballast to stabilize the enclosure and further minimize possible dampening of the toy.

FIG. 1 discloses chambered enclosure 10 constructed with wall portions comprising sidewalls 24 and a base 27. The sidewalls form access structure for inserting a toy into the enclosure. In the embodiment shown in FIG. 1, sidewalls 24 form a top rim 31 designed for cooperative engagement with an openable portion 34. The top rim provides access to the dry chamber 15 within which the toy 17 may be placed to keep the toy in a dry condition. Handle means 38 is optionally provided for ease of portability.

Wet chamber 21 is formed by base 27 and the portion of sidewalls 24 extending beneath/beyond dry chamber 15. Wet chamber 21 is separated from dry chamber 15 by an internal solid wall 39 extending between the sidewalls to prevent any migration of water from the wet chamber to the dry chamber. Internal solid wall 39 also comprises means for holding toy 17 within enclosure 10.

Figure 2:
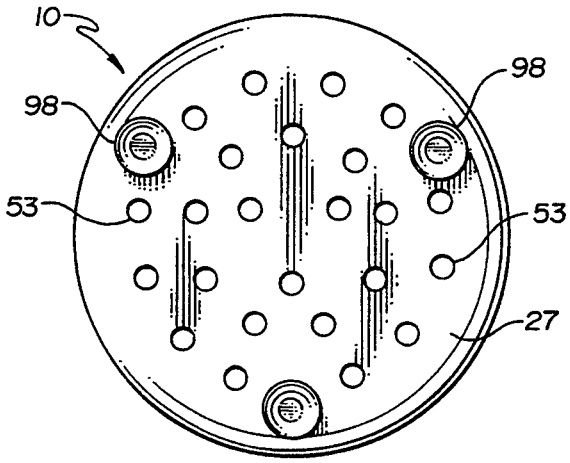
FIG. 2 is a bottom view of the chambered enclosure of FIG. 1 disclosing apertures for allowing water to enter the wet chamber of the enclosure.

FIG. 2 is a bottom plan view taken along lines 2—2 of FIG. 1 in which wet chamber ballasting means 53 is shown as a plurality of apertures formed by base 27. Wet chamber ballasting means 53 is provided for allowing water to enter wet chamber 21 to provide ballast to stabilize enclosure 10. The apertures may be formed with variously sized holes and preferably provide means for allowing water to enter wet chamber 21 in a free flooding configuration in order to stabilize and ballast chambered enclosure 10 to prevent tipping of the enclosure. Wet chamber ballasting means is quite helpful when chambered enclosure 10 is used by very young children who are not adept at placing objects in stable upright positions. The flooding of water into wet chamber 21 provides a weight for enclosure 10 when it is in use in a wet environment but does not add extra weight when a child is transporting or using chambered enclosure 10 in a dry environment. This is also helpful in view of the inability of young children to carry heavy objects. Preferably, the apertures forming ballasting means 53 are designed to be large enough to prevent entangling of children's fingers or other small sized toys or objects within wet chamber 21. It is also preferable that the size of dry chamber 15 be suitable for placing most medium and small sized toys in the chamber but entirely unsuitable for any possible placement of babies or pets in dry enclosure due to improper use of the article.

Figure 3:
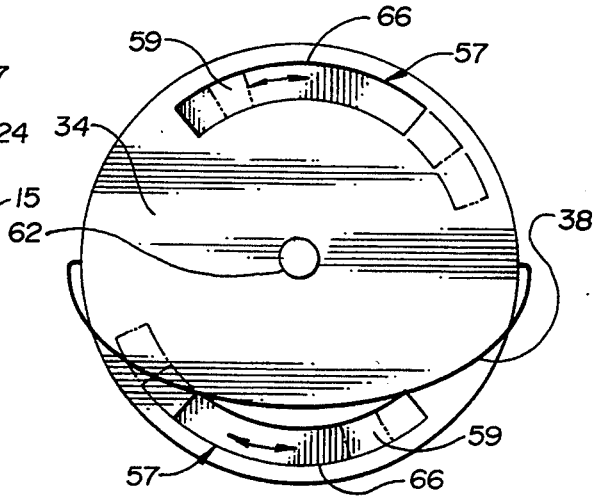
FIG. 3 is a top view of the chambered enclosure of FIG. 1.

However, as shown in FIG. 3, it is possible to provide an optional adult-controlled airway mechanism 57 in openable portion 34 which normally permits air to enter the dry chamber unless an adult override of this feature is actuated. This reduces the likelihood of the dry chamber being placed in a configuration of reduced oxygen content coinciding with its waterproof condition except under supervision of an adult. Mechanism 57 is shown as a rotating circular member 59 controlled by optional child-proof knob controller 62, by frictional contact, or by other means. FIG. 3 shows mechanism 57 in a closed configuration with no air or water passage possible through slots 66. In a normally open configuration circular member 59 is rotated so that air (and water) may pass through the slots.

Figure 4:
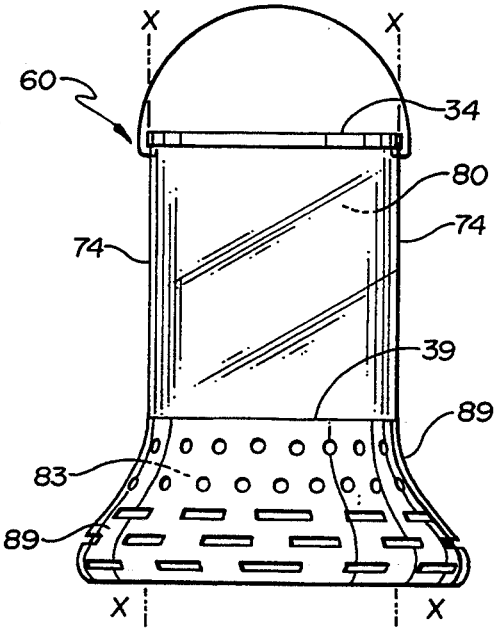
FIG. 4 is a chambered enclosure with a flared base.
Figure 5:
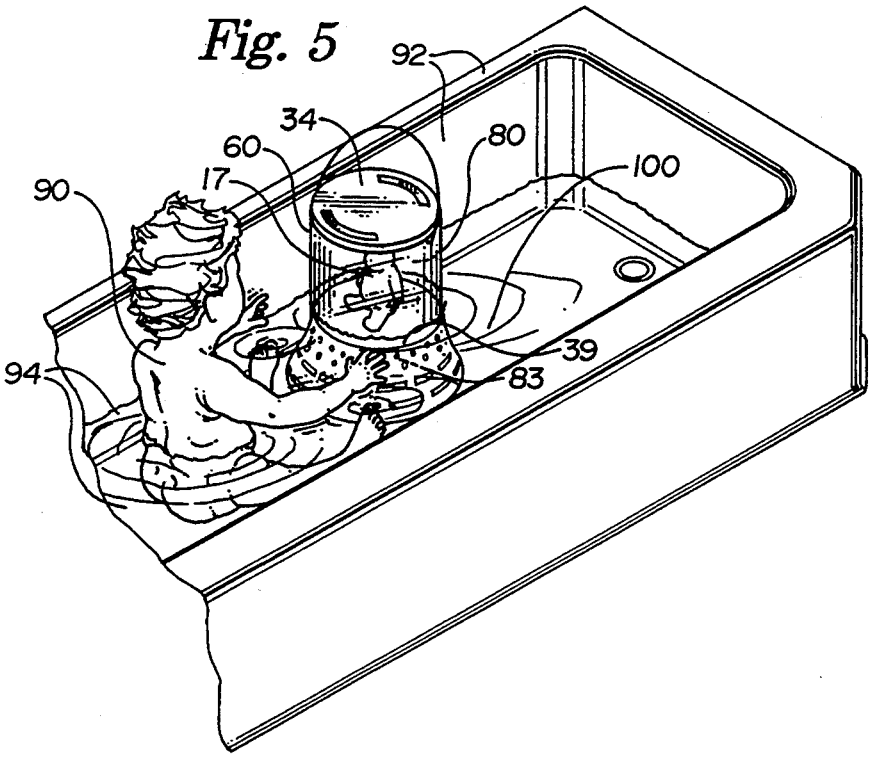
FIG. 5 is a schematic view of a child in a bath tub using a chambered enclosure for holding a toy in a dry condition.

FIG. 4 discloses another embodiment of a chambered enclosure 60 comprising sidewalls 74 forming dry chamber 80 and wet chamber 83. The wet chamber comprises sidewall portion 89 which extends beyond a vertical plane X formed by dry chamber sidewalls. Chambered enclosure 60 provides a wider wet chamber to further assist in the ballasting and stabilization of the enclosure. FIG. 5 illustrates use of chambered enclosure 60 by a child 90 sitting in a bath tub 92. As shown, chamber enclosure 60 has a toy animal 17 placed within dry chamber 80 and wet chamber 83 is flooded with water 94. This flooding provides ballast sufficient for either partially or entirely submerging enclosure 60 depending on the depth of the water and the amount of reserve buoyancy of enclosure 60. In particular, the relative volume of wet chamber 83 versus dry chamber 80 determines the buoyancy of chambered enclosure 60, according to well known principles. Various configurations exist in which additional double walled ballast tank configurations may be provided along the wall portions comprising the outer walls of either dry chamber 15 or dry chamber 80, as well as differently shaped or weighted wet chamber walls. One example comprises enclosure 60 having walls shaped as a ship or vessel.

Figure 6:
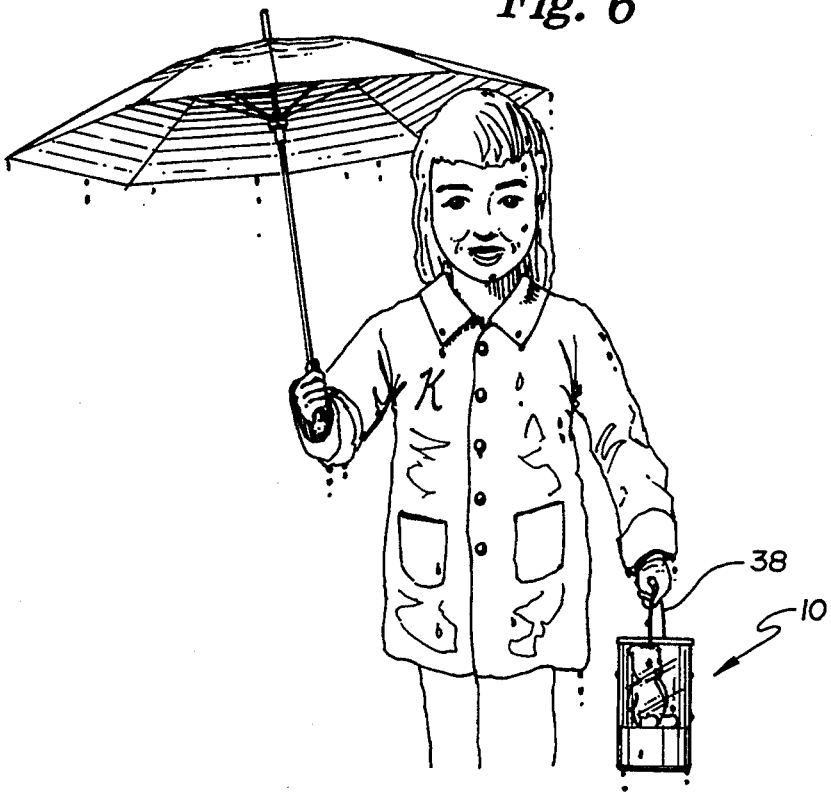
FIG. 6 is a schematic view of a child walking while holding a chambered enclosure suitable for holding a toy in a dry condition.

Openable portion 34 is preferably in a water tight configuration when used in a wet environment such as a bath tub, in order to actually prevent the toy from getting wet through splashing or submersion. Each chambered enclosure 10 or 60 provides numerous additional opportunities and hours of fun play for children when they are in a wet environment, such as the bath tub shown in FIG. 5 or the outdoors rain environment of FIG. 6. FIG. 6 also shows use of handle means 38, which may be variously shaped or attached, for carrying a chambered enclosure in a convenient manner by a child. Handle means 10 may also simply comprise a handle placed on a side or top portion of a chambered enclosure. Use of chambered enclosure 10 or chambered enclosure 60 with a wet chamber permits outdoors activity and placement of the enclosure on a wet ground or in puddles without loss of stability to the enclosure. The same principles of ballasting apply as in a tub or other type of water environment.

A preferred chambered enclosure comprises portions manufactured from a transparent or translucent material so that the user may fully enjoy the perceived satisfaction of the toy sitting in a dry state within the enclosure. In addition, frictional means 98, shown in FIG. 2, may be employed to assist in anchoring or firmly placing the enclosure on a tub base 100 or other surface. Frictional means may comprise devices such as suction cups or other attaching surfaces. Other modifications and features of the basic design of a chambered enclosure are recognized and are within the scope of this patent. Examples of such modifications include variously sized and shaped enclosures, multi-colored enclosures, internally baffled enclosures, enclosures with nautical paraphernalia, and various forms and shapes of openable portions or means for closing and sealing the openable portions in a water tight configuration. For example, it is possible to have an openable portion placed in a sidewall rather than at a top portion of a chambered enclosure formed by sidewalls.

I claim:

1. A chambered enclosure for holding a toy within the enclosure to maintain the toy in a dry condition while portions of the enclosure are getting wet, comprising:

a) a container having wall portions comprising sidewalls and a base, the side walls having portions forming part of the walls defining a dry chamber and a wet chamber within the enclosure, the sidewalls further forming a rim designed for cooperative engagement with an enclosure openable portion which is selectively configurable as a watertight closeable portion, the rim providing access to the dry chamber within which a toy may be placed to keep the toy dry;

b) a wet chamber formed by the base and portions of the sidewalls extending beyond the dry chamber, the wet chamber being separated from the dry chamber by an internal solid wall extending between the sidewalls, the internal solid wall comprising means for holding the toy placed within the enclosure; and c) wet chamber ballasting means for allowing water to enter the wet chamber to provide ballast to stabilize the enclosure.

2. The enclosure of claim 1 in which the sidewalls are manufactured from a translucent material.

3. The enclosure of claim 1 in which the ballasting means comprises a plurality of apertures formed by portions of the sidewalls.

4. The enclosure of claim 1 in which the ballasting means comprises a plurality of apertures formed by portions of the base.

5. The enclosure of claim 1 in which the wet chamber comprises at least one sidewall portion which extends beyond a vertical plane formed by the dry chamber sidewall portions.

6. The enclosure of claim 1 in which the openable portion is designed for contact with a portion of the sidewalls; the openable portion comprising means for sealing, in a waterproof manner, the access through which the toy is placed in the enclosure.

7. The enclosure of claim 6 in which the openable portion comprises a child-proof airway mechanism to provide normally open airways through the openable portion which may be selectively placed in a closed condition by an adult for use of the enclosure in a wet environment.

8. The enclosure of claim 1 in which the base comprises means for positioning the enclosure on a surface.

9. The enclosure of claim 1 in which the ballasting means comprises wet chamber wall portions which are of heavier material than the material forming the dry chamber wall portions.

10. The enclosure of claim 1 further comprising handle means to assist in the portability of the enclosure.

11. A chambered enclosure for holding a toy in a dry condition while portions of the enclosure are getting wet, comprising:

a) wall portions including sidewalls and a base connected to the sidewalls, the wall portions forming an openable portion selectively configurable as a waterproof closeable portion, the openable portion providing access to a dry chamber within the enclosure into which a toy may be placed to keep the toy dry;

b) a dry chamber, formed within the enclosure by the wall portions, and a wet chamber, formed by the base and portions of the sidewalls extending beyond the dry chamber; the wet chamber being separated from the dry chamber by an internal solid wall extending between the sidewalls, the internal solid wall comprising a surface for holding the toy placed within the enclosure; and c) ballasting means for allowing water to enter the wet chamber to provide ballast to stabilize the enclosure.

* * * * *